United States Patent [19]

Dougan et al.

[11] Patent Number: 4,721,258

[45] Date of Patent: Jan. 26, 1988

[54] ROLL-AND-RACE PULVERIZER WITH ROTATING THROAT

[75] Inventors: Donald R. Dougan, North Canton; Gerald W. Peters, Canal Fulton; William C. Kish, Akron, all of Ohio

[73] Assignee: The Babcock & Wilcox Company, New Orleans, La.

[21] Appl. No.: 63,544

[22] Filed: Jun. 17, 1987

Related U.S. Application Data

[62] Division of Ser. No. 808,130, Dec. 12, 1985, Pat. No. 4,697,145.

[51] Int. Cl.[4] ..... B02C 15/06

[52] U.S. Cl. ..... 241/57; 241/103; 241/119; 241/121

[58] Field of Search ..... 241/57, 58, 60, 103, 241/107, 109, 115–122

[56] References Cited

U.S. PATENT DOCUMENTS 4,264,041 4/1981 Kitto, Jr. et al. ..... 241/57

FOREIGN PATENT DOCUMENTS 1055926 4/1959 Fed. Rep. of Germany ..... 241/117

1152297 8/1963 Fed. Rep. of Germany ..... 241/119

*Primary Examiner*—Timothy V. Eley

*Attorney, Agent, or Firm*—Vytas R. Matas; Robert J. Edwards

[57] ABSTRACT

A roll-and-race pulverizer is disclosed in which the throat vanes are mounted for rotation in the direction of rotation of the grinding ring.

2 Claims, 4 Drawing Figures

ROLL-AND-RACE PULVERIZER WITH ROTATING THROAT

This is a division of application Ser. No. 06/808,130, filed Dec. 12, 1985 now U.S. Pat. No. 4,697,145.

BACKGROUND OF THE INVENTION

The present invention relates to pulverizers in which materials such as coal are pulverized to a required fineness between relatively moving grinding surfaces and, more particularly, to a roll-and-race type pulverizer that is provided with a rotating throat and improved throat design.

Pulverizers utilize crushing pressure, impact and attrition between grinding surfaces to reduce materials to a fine particle size. Roll-and-race pulverizers are among the several types of pulverizer designs that are commonly employed, particularly to prepare coal for the firing of boilers. In roll-and-race pulverizing, the grinding assemblies essentially comprise rolls mounted within grinding rings. In the so-called standard roll-and race pulverizer, the ring is stationary and the rolls rotate. In the so-called bowl mill roll-and-race pulverizer, the rolls are stationary and the ring rotates.

The principal components of a bowl mill are a rotating bowl which is equipped with a replaceable grinding ring, a plurality of rolls mounted in stationary journals, an automatically controlled feeder, a classifer, and a drive. The rolls in the bowl mill are resiliently urged against the grinding ring by springs which apply force to the axles of the rolls. Raw coal fed to the pulverizer mixes with partially ground coal that is circulated within the grinding zone by a stream of air which flows through the pulverizer. As the coal is reduced in size, it is fluidized by the air and carried to the classifier. The properly-sized pulverized coal is pneumatically conveyed from the pulverizer through outlet pipes. Oversized coal is returned to the grinding zone.

The carrier air generally passes upwardly from a plenum through an annular throat and picks up the ground coal along the outer edge of the grinding ring. The throat is divided into a plurality of circumferential segments by vanes that radially extend between an inner circular throat wall and an outer circular throat wall. Excessive air pressure losses, the non-uniform distribution of air within the segments and the dribble of materials downwardly through the throat against the ascending stream of air have been persistent problems in the art of pulverizer design.

Throughout the years, many designs have been proposed in an effort to resolve such problems. See, for example, U.S. Pat. Nos. 2,275,595, 2,378,681, 2,389,844, 2,431,746, 2,473,514, 2,545,254, 2,698,142, 4,264,041 and 4,523,721.

U.S. Pat. No. 4,264,041, which is assigned to the assignee of the present invention, discloses an improved stationary vane configuration. The stationary vanes extend over the radial width of the throat and are designed with a tear-drop and air foil vane shape to provide an acceleration of carrier air flow rates within the throat in order to produce a more uniform throat velocity while maintaining threshold velocities needed to preclude dribble of the pulverized material. Although representing an improvement, tests of coal pulverizers, employing the stationary vane design of U.S. Pat. No. 4,264,041, reveal that air flow rates vary as much as fifteen percent from the average with no coal in the pulverizer and as much as twenty-five percent from the average when coal is present. Consequently, the large variation in flow rates has dictated the need to use greater overall flows to be sure that minimum threshold velocities are achieved. The additional overall flow requires additional fan power consumption. In addition, variations in the flow rates create a non-uniform flow of coal off of the grinding ring and results in uneven throat wear and vane erosion since certain throat openings or vanes are being subjected to higher or lower than average velocities.

SUMMARY OF THE INVENTION

In accordance with the present invention, the throat vanes, which are inclined with their upper edges disposed in the direction of rotation of the grinding ring, are arranged to rotate concurrently with and in the direction of rotation of the grinding ring. More particularly, an improved roll-and-race pulverizer includes means for circumferentially rotating the vanes within the annular throat opening in the direction of the rotation of the grinding ring. In a preferred embodiment of the invention, the vanes are secured to the grinding ring via the mechanical attachment of an inner circular wall, to which the vanes are fixed, to a ring seat on which the grinding ring is mounted.

The present invention permits designing for minimum velocities in the throat to prevent dribble, which permits operation with a decreased air flow in the pulverizer from minimum to full load. The rotation of the inside throat wall and vanes prevents any throat opening or vanes from being constantly subjected to either high or low velocity air flow and high or low coal flow off the grinding ring. The coal loading on the top of the throat ring is spread out around the entire circumferential length of the throat making it more uniform. Any object starting to fall through the throat in a low flow area which does not fall through quickly, since the throat vanes are rotating, is rapidly moved to higher flow areas.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
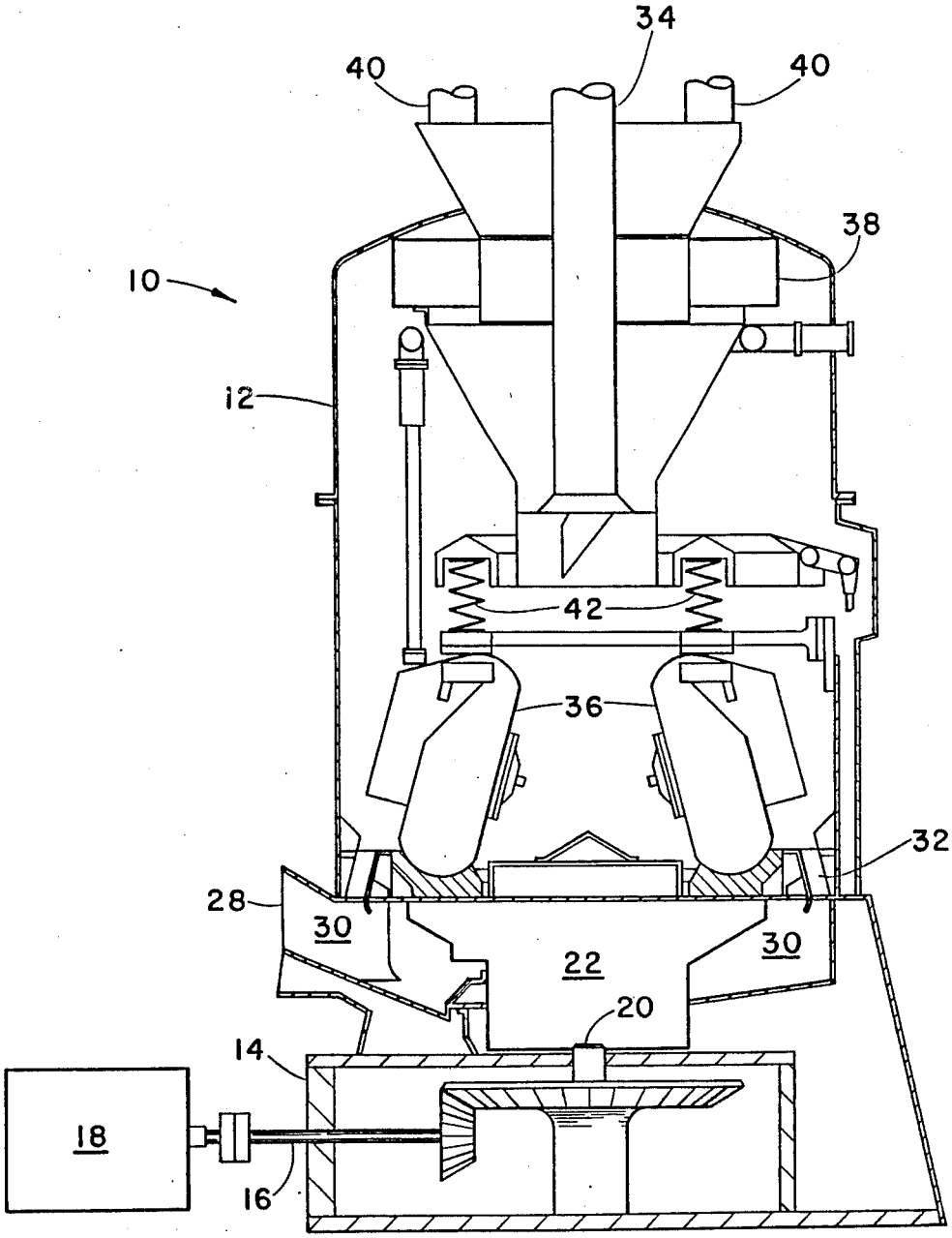
FIG. 1 is a schematic view, partly in section, of a pulverizer embodying the invention.
Figure 2:
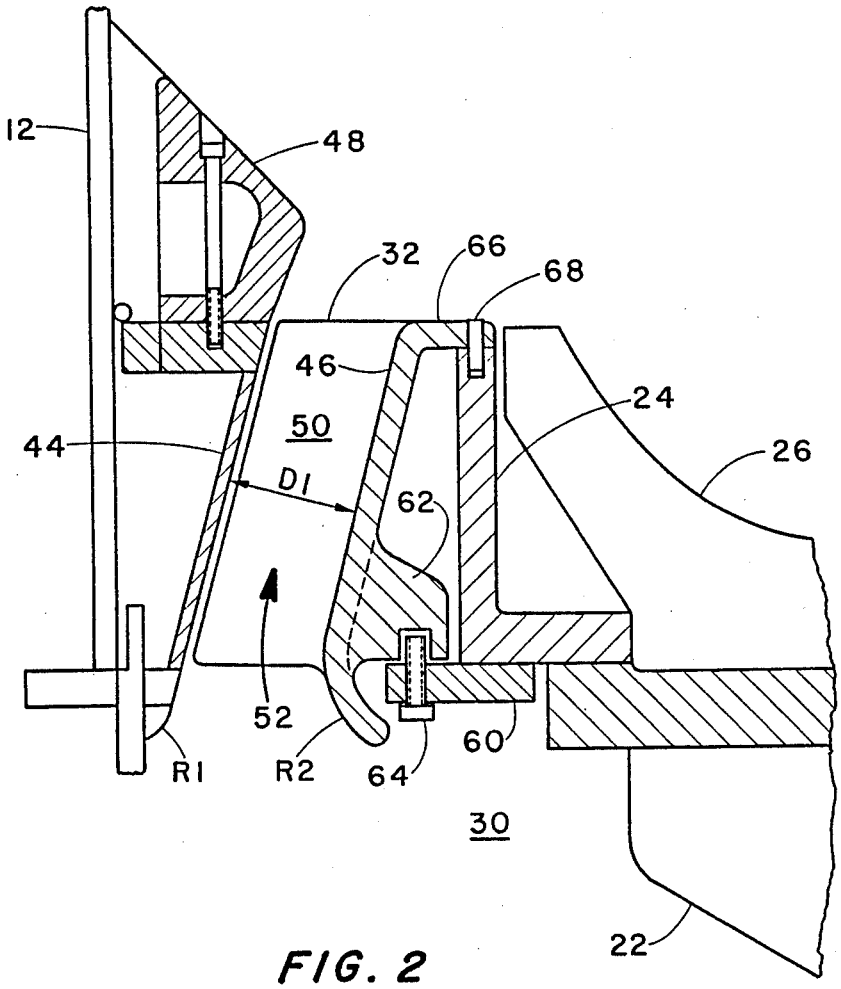
FIG. 2 is a partial sectional view of a portion of the throat of the pulverizer shown in FIG. 1.

Referring to FIG. 1, there is shown a roll-and-race pulverizer 10 including a generally cylindrical upper housing 12 mounted above a gear box 14. The gear box 14 contains a pulverizer drive assembly including a horizontal pinion shaft 16 operatively connected to a vertical drive shaft 20 axially connecting upwardly to a drive yoke 22. As is shown in FIG. 2, the drive yoke 22 includes a ring seat 24. A grinding ring 26 is mounted on ring seat 24 and is designed to rotate with the yoke 22. A drive 18, connected to the pulverizer drive assembly, is operable to rotate the yoke 22, the ring seat 24 and the grinding ring 26 about a vertical central axis.

A nozzle 28 provides an air inlet into a plenum chamber 30 which, in turn, communicates with and supplies carrier air to the pulverizer throat 32 which is defined by an annular opening between the grinding ring 26 and the inner wall of the housing 12. The material to be pulverized is supplied through an inlet pipe 34 to the inner side of the grinding ring 26 and deposits on the inside upper surface of the grinding ring 26. The material is distributed throughout the grinding area by rotation of the drive yoke 22 and the associated grinding ring 26. Material is pulverized between rolls 36 and the grinding ring 26. As the material is reduced in size, the air carries it to the classifier 38. The pulverized material, along with the air, leaves the pulverizer through the outlet pipes 40.

The rolls 36, as noted, cooperate with the circular race of the grinding ring 26 to grind the material. The rolls 36 rotate in place and do not revolve about the central axis of the pulverizer. The grinding action is effected by the relative motion of the ring 26 and rolls 36. A downward force is applied on the axles of rolls 36 by resilient springs 42 thereby, providing a compressive force between the rolls 36 and the ring 26 for proper grinding action.

FIG. 2 is an enlarged sectional view of a portion of the annular opening comprising the pulverizer throat 32. A circular outer throat wall 44, a circular inner throat wall 46, a throat ledge cover 48 and vanes 50 define the configuration of the throat. Each of the vanes 50 radially extend within the annular opening 32 through the distance between the inner and outer throat wa11s 44, 46. The vanes 50 vertically extend within the annular opening at an angle with the horizontal 56 (see FIG. 4) for substantially the entire height of the throat. The upper ends 54 of the vanes 50 are disposed in advance in the direction 58 of rotation of the grinding ring 26. The vanes 50 are located around the throat at circumferentially spaced locations so as to divide the carrier air, which enters from below the throat, into a plurality of streams 52*a*, 52*b* (see FIG. 4) between successive vanes 50 for distributing the air about the grinding ring 26.

Figure 3:
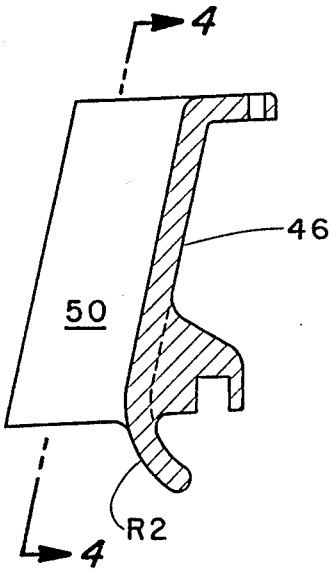
FIG. 3 is a partial sectional view of a vane of the pulverizer throat.

FIG. 3 illustrates a segment of the inner throat wall 46 and an attached throat vane 50. In a preferred embodiment of the apparatus, the circular inner throat wall 46, as is best shown in FIGS. 2 and 3, is connected to the ring seat 24 so that the vanes 50 rotate with the ring seat.

A transverse plate 60, fixed to the ring seat 24, radially extends into the annular opening. The inner throat wall is provided with a mounting surface 62 which bears upon the transverse plate 60. The transverse plate 60 is secured to the mounting surface 62 by bolts 64. Additional support is provided by an inwardly projecting lateral lip 66 at the top of the inner wall 46. The lateral lip 66 rests upon the ring seat 24. The lip 66 is secured to the seat 24 by a pin 68. Alternatively, the outer throat wall 44 is fixed to the adjacent edges of vanes for rotation therewith. In still a further alternative arrangement, separate means for supporting and rotating the vanes in the direction of the rotation of the grinding ring could be utilized.

FIG. 2 illustrates large, extended radii of curvature R1 and R2 at the throat inlet as disclosed in U.S. Pat. No. 4,264,041, the disclosure of which is incorporated herein by reference. The ratio of the radii of curvature R1 and R2 to the radial width of the annular opening or throat D1 is greater than 0.5 and less than 1.5. The outer throat wall 44 and throat ledge cover 48 are mounted to the housing 12 and are stationary. The circumferential length of the lower throat is divided by a plurality of vanes 50 extending from the throat inlet to the upper throat outlet.

Figure 4:
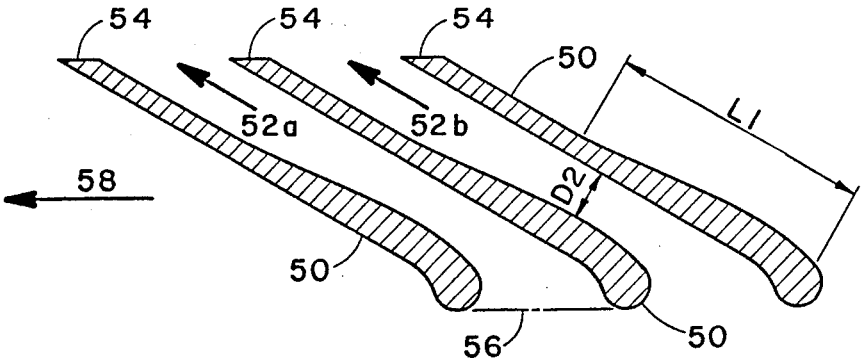
FIG. 4 is a sectional view taken along line 4—4 of FIG. 3.

FIG. 4 depicts three adjacent vanes 50. The vanes 50 extend from the throat inlet to the throat outlet, at an inclined angle to the horizontal, preferably of thirty degrees. The vanes are designed with a tear drop shape, in section, at their lower end and have an air foil shape on a portion of the upper end similar to that shown in U.S. Pat. No. 4,264,041. The upper end of each vane 50 has a constant thickness. The ratio of the airfoil length L1 to the minimum distance between vanes D2 is greater than 1.0 and less than 5.0.

The air inlet nozzle 28, FIG. 1, delivers primary or carrier air at one location radially into plenum chamber 30, FIG. 1. Arrow 52 generally indicates the direction of air flow through the throat. The air passes from the plenum chamber up through the throat. In the throat, the air stream is divided into a multiplicity of air flow streams by the vanes. The vanes are concurrently rotated with the grinding ring.

Tests have shown that the air flow could, as compared to the stationary design of U.S. Pat. No. 4,264,041, be reduced by at least 15% without any dribble problems using the present invention. This reduction in air flow, and the attendant pressure drop, provide very significant savings in fan power requirements. Tests show the throat wear to be very uniform around the circumferential length of the throat, since sections of the inside throat wall and vanes are not constantly subjected to high or low air flow and the coal loading is more uniform on the top of the throat. This uniform wear provides a major maintenance benefit. The existing stationary design throats have shown extremely high wear of the throat vanes and outer throat wall in some localized areas around the throat. Tests also indicate that the housing wear immediately above the throat ledge covers is greatly reduced with the structure of the present invention.

The inventive arrangement may be readily employed in the replacement of existing stationary throat designs. The inner throat wall, outer throat wall and throat ledge may be constructed in segments for ease of installation.

The invention claimed is:

1. A pulverizer throat assembly for a roll-and-race pulverizer having an annular opening for mounting circumferentially rotatable airfoil vanes within said annular opening, comprising:

a pulverizer throat, mountable within the annular opening and having a configuration defined by a circular outer throat wall having an inlet radius of curvature R1, a circular inner throat wall having an inlet radius of curvature R2, a throat ledge cover, and circumferentially rotatable airfoil vanes, said vanes having a teardrop shape at a lower end and an airfoil shape on a portion of an upper end of a length L1, said upper end having a constant thickness, said vanes radially extendable within the annular opening across the radial width thereof and at circumferentially spaced locations between successive vanes such that a ratio of the airfoil length L1 to a minimum distance between vanes D2 is greater than 1.0 and less than 5.0, and such that a ratio of the radii of curvature R1 and R2 to the radial width of the annular opening is greater than 0.5 and less than 1.5, and wherein the vanes are vertically extendable within the annular opening at an angle from the horizontal with their upper ends in advance with respect to the circumferential direction of rotation thereof.

2. A pulverizer throat assembly as set forth in claim 1, wherein said inner throat wall, said outer throat wall and said throat ledge cover are constructed in segments for ease of installation in said roll-and-race pulverizer.

* * * * *